US006945733B2

(12) United States Patent
Rathmann et al.

(10) Patent No.: US 6,945,733 B2
(45) Date of Patent: Sep. 20, 2005

(54) COVER FOR A DRAINAGE DEVICE

(75) Inventors: Axel Rathmann, Oldenswort (DE); Manfred Rinckens, Ellerau (DE)

(73) Assignee: ACO Severin Ahlmann GmbH & Co. KG, Rendsburg (DE)

( * ) Notice: Subject to any disclaimer, the term of this patent is extended or adjusted under 35 U.S.C. 154(b) by 0 days.

(21) Appl. No.: 10/476,766

(22) PCT Filed: Apr. 30, 2002

(86) PCT No.: PCT/EP02/04766

§ 371 (c)(1),
(2), (4) Date: Feb. 19, 2004

(87) PCT Pub. No.: WO02/090675

PCT Pub. Date: Nov. 14, 2002

(65) Prior Publication Data

US 2004/0126187 A1 Jul. 1, 2004

(30) Foreign Application Priority Data

May 4, 2001 (DE) ..... 101 21 661
Jun. 27, 2001 (DE) ..... 101 30 920

(51) Int. Cl.[7] ..... E02B 5/00; E01C 11/22

(52) U.S. Cl. ..... 405/118; 405/40; 405/122; 404/2; 404/4; 210/163

(58) Field of Search ..... 405/36, 40, 46, 405/118, 122, 123; 404/2–5; 52/11; 210/163

(56) References Cited

U.S. PATENT DOCUMENTS 1,941,589 A 1/1934 Wellons
4,594,157 A 6/1986 McGowan
RE33,439 E * 11/1990 Thomann et al. ..... 404/2
5,066,165 A * 11/1991 Wofford et al. ..... 405/118
5,181,793 A * 1/1993 Dekel ..... 404/4
5,388,377 A * 2/1995 Faulkner ..... 52/11
5,564,860 A * 10/1996 Amann ..... 405/118
5,853,265 A * 12/1998 Gunter ..... 405/118

FOREIGN PATENT DOCUMENTS

| | | |
|---|---|---|
| DE | 30 16 465 | 12/1980 |
| DE | 36 18 699 | 12/1987 |
| DE | 295 02 387.2 | 4/1995 |
| DE | 195 04 869 | 6/1996 |
| DE | 297 10 643 | 9/1997 |
| DE | 297 11 424 | 10/1997 |
| EP | 0 476 672 | 3/1992 |
| EP | 0578445 | * 12/1994 |
| EP | 0 886 014 | 6/1998 |
| GB | 2 351 992 | 1/2001 |

OTHER PUBLICATIONS

Brochure of MEA Meisinger, 86543 Aichach, Mearin 100 Topfix Entwässerungsrinne (Jan. 2001).
Brochure of MEA Meisinger, 86543 Aichach, "Meadrain Entwässerungssyteme EN 1000" (Jan. 2001).

* cited by examiner

*Primary Examiner*—Jong-Suk (James) Lee
(74) *Attorney, Agent, or Firm*—Merchant & Gould P.C.

(57) ABSTRACT

A cover for a drainage device, in particular a drainage channel with a channel body such that the cover can be set on an upper edge of the channel body, which comprises detent ridges that extend into the channel body and which has at least one fixing element to attach the cover to the channel body or to a frame disposed on the channel body to reinforce its upper edge, such that in a locked state the fixing element engages a recess in the channel body or frame. In order to achieve durable fixation of the cover on the channel body, while enabling the fixing element to be simple to manufacture and install, and the channel cross-section to remain free, the detent ridges comprise at least one aperture to guide the fixing element, which projects out of that aperture.

19 Claims, 2 Drawing Sheets

COVER FOR A DRAINAGE DEVICE

RELATED U.S. APPLICATIONS

This application is a 371 of corresponding PCT application No. PCT/EP02/04766 filed Apr. 30, 2002, and designating the U.S.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a cover for a drainage device, in particular a drainage channel with a channel body, such that the cover can be set onto the upper edge of the channel body. The cover comprises detent ridges projecting into the channel body, with at least one fixing element to fix the cover to the channel body or to a capping frame disposed on the channel body to reinforce the upper edge.

BACKGROUND OF THE INVENTION

There are known kinds of drainage apparatus, in particular drainage channels or the like, in which the cover can be attached to the channel body by means of fixing elements.

Patent DE 195 04 869 Cl discloses a drainage channel with a cover grid that can be attached to a channel body. The grid is locked into position by means of a leaf-shaped locking spring, which comprises overhangs disposed opposite one another that engage recesses in the side walls of the channel body. After the overhangs have become engaged or locked into place, the locking spring of the grid rests in the interior of the channel body, in a substantially tension-free position. When the grid is set into the channel body and pressed down sufficiently to overcome the spring force, catch irons mounted on the cover grid, with arms bent at an angle, lock the grid into position.

This known drainage device, with a cover grid provided with a locking spring, presents the disadvantage that the locking spring is disposed in the interior of the channel body, in particular is transverse to its long axis. Hence the cross section of the channel is not completely free, which can cause blockages and/or makes cleaning substantially more difficult. Another disadvantage is that the walls of the channel body comprise recesses that serve to engage the locking springs and are disposed essentially at half height on the sides of the channel body. As this entails severe surface loading, the stability and the working life of the channel body are thereby impaired.

BRIEF SUMMARY OF THE INVENTION

The object of the invention is thus the further development of a cover for a drainage device having a fixing arrangement of the kind cited above, with the aim, firstly, of ensuring a durable fixation of the cover to the channel body, along with simplicity of manufacture and assembly, and secondly of enabling the channel cross section to be fully open.

According to the present invention there is provided a cover for a drainage device, in which a drainage channel defined by a channel body has an upper edge on which the cover can be set, comprising detent ridges that can extend into the channel body, and at least one fixing element to attach the cover either to the channel body or to a capping frame disposed on the channel body to reinforce its upper edge such that in a locked state the fixing element engages a recess defined by at least one of the channel body and the frame, the detent ridges extending into the channel body and themselves defining at least one aperture to guide the fixing element which projects out of the aperture.

A fundamental idea underlying the invention is that the fixing element is guided through the opening. Thus the stability of fixation does not depend exclusively on the fixing element and its stability. The connection in this case is a catch connection.

Because the locking occurs in the upper region of the channel body, after the cover has been set onto the channel body a free cross section remains available. As a result, optimized hydraulic performance is ensured.

Preferably there is an aperture with a bottom edge such that in the engaged state the fixing element has been inserted between this bottom edge and a stopping surface of the recess. Then the fixing element can be constructed very simply and easily, because it acts like a door latch that has snapped into a lock.

When a capping frame has been provided to reinforce the upper edge of the channel body, the part of the fixing element projecting out of the aperture engages the recess in the body wall below the frame, in which case the frame serves as retaining element for the locking mechanism. Hence the locking occurs in the upper region of the channel body, immediately below the cover.

Preferably the fixing element is constructed as a locking spring. The fixing element preferably comprises a middle section, at the ends of which extensions are provided by means of which the cover is locked to the channel body. In this case the extensions are inserted into the apertures in the detent ridges. The middle section extends immediately below the cover and can preferably be fixed to a lower surface of the cover. This ensures better retention of the fixing element and also increases the security of the locking.

The extensions of the fixing element, which serve to form inclined surfaces tilted away from the horizontal, are preferably made mirror-symmetrical and conically tapering. These extensions comprise a first and a second angled section. The second angled section is lug-shaped and engages the aperture in the detent ridge, in order to connect the fixing element to the cover. In this position, the free ends of the fixing element extend towards the interior of the channel. When the fixing element is attached to the cover, the retaining lugs project out of the apertures in the detent ridges. Thus the fixing element can be inserted into the cover relatively easily. Then the cover can be set onto the channel body and fixed there, the retaining lugs having been caught within the recesses in the channel walls.

Preferably the capping frame is bent at an angle so that its inner edge points towards the channel floor and forms a stopping surface for engagement with the fixing element. The frame section that is angled downward and the detent ridges, which likewise extend towards the channel floor, are aligned side by side when the cover has been set into position.

The fixing elements are preferably so constructed that when the cover is being set onto the channel body, the retaining lugs formed by the fixing elements, which project out of the apertures in the cover, slide along the channel body or the frame. In this process the fixing elements, while being pressed towards the interior of the channel, can be elastically deformed. When the cover reaches a final position on the channel body, the retaining lugs snap into the recesses. This catch connection locks the cover reliably in place, on one hand, while on the other hand it adequately secures the cover against being unintentionally lifted off.

Preferably when the cover is in its locked-in state, the fixing element applies a force to hold it against the body or the ridges. Hence the cover is fixed in the channel body with no play.

It is also preferable for the fixing element to be so constructed that the force required to deform the fixing element is less than that needed to release the locking and lift the cover off. Thus the cover is securely attached to the channel body, and is taken away only when repair or cleaning operations are necessary.

Preferably the recesses in the channel walls, into which the retaining lugs of the fixing element are inserted when in the locked position, are constructed so as to be closed in the region of the outer surface. This measure both prevents dirt from entering and increases the mechanical stability of the channel body, to which severe loads are applied.

The width of the fixing element preferably corresponds substantially to the width of the recesses in the channel walls. By this means it is ensured that, in addition to being locked down, the cover will not be displaced horizontally with respect to the channel body. Hence there is no need for supplementary devices to prevent such displacement.

The fixing element can preferably be made in one piece, although a partially one-piece design is also possible. The fixing element can be made both of metal and also as a plastic part, in particular in the form of injection-molded plastic.

The cover can be formed from sheets of steel, stainless steel or cast iron, or also of plastic.

The cover is preferably constructed as a grid. In this case the fixing element can be dimensioned such that the middle section of the fixing element can be disposed under one of the bars of the grid. Thus the fixing element is inaccessible from the surface, ensuring protection from vandals.

Other preferred implementations of the invention will be apparent from the subordinate claims and the following description of exemplary embodiments. These are explained with reference to the drawings as follows.

BRIEF DESCRIPTION OF THE OF THE DRAWING

DETAILED DESCRIPTION OF THE INVENTION

Figure 1:
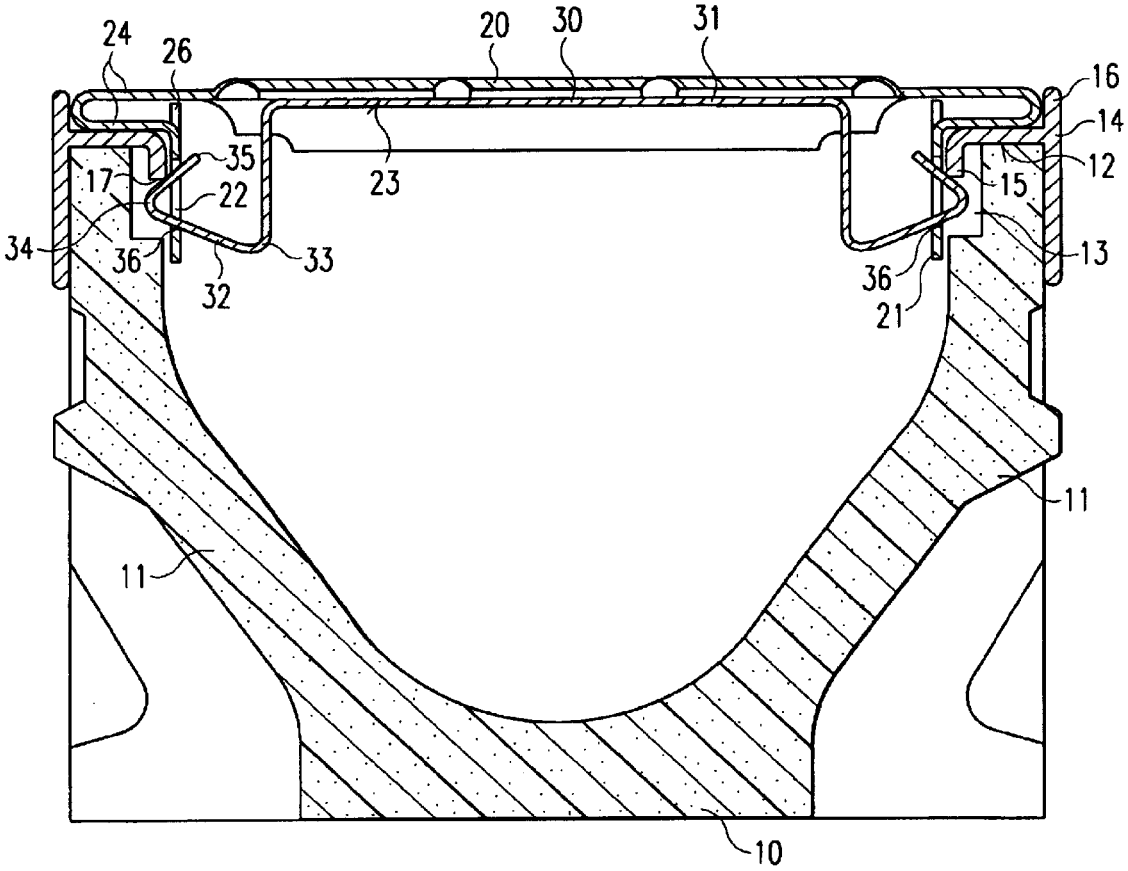
FIG. 1 is a cross section through a drainage channel with a locking spring.

In the following description, the same reference numerals are used for identical parts or parts with identical actions.

FIG. 1 shows a cross section through a drainage channel with a locking spring 30. The drainage channel comprises a channel body 10, which can be installed in the ground, and a cover 20 to be set onto the channel body 10. The locking spring 30 is used to fix the cover 20 in place on the channel body 10.

The channel body 10 is substantially V-shaped, although another configuration, for instance U-shaped, is likewise possible. The channel body 10 is made of polymer concrete and consists of a lower body with side walls 11 plus a capping frame 14. The frame 14 serves on one hand to reinforce the upper edge 12 of the channel walls 11 and as a support for the cover 20, while on the other hand it is a retaining element for the locking mechanism of the cover 20. The frame 14 is made of metal.

The cover 20 is a grid made of bent metal bars, although another design, for instance as a mesh grid, is likewise possible. At its long edges the cover 20 is folded to form a double-layered surface 24. The surface 24 is integrally continuous with detent ridges 21, which extend downward so as to point toward the channel floor. The detent ridges 21 have been punched out to form ends 26 that are bent upward, pointing toward the surface. The ends 26 of the detent ridges 21 serve as a support for the cover 20, in the innermost region of the edge surface. This considerably increases the resistance of the cover 20 to bending.

When the cover 20 is in position on the channel body 10, the edge surface 24 rests on the capping frame 14. The inner part of the frame 14 is bent downward. The frame 14 also comprises a projection 16 so dimensioned that its height corresponds to the height of the double-layered surface 24, so that the edges of the cover 20 in the long direction of the channel are enclosed by the frame 14.

As the cover 20 is being set onto the channel body 10, the detent ridges 21 descend past the recesses 13 disposed in the channel walls 11 as part of the locking mechanism. The detent ridges 21 are provided with apertures 22, which correspond to the recesses 13 formed by the channel walls 11 and frames 14, respectively. The apertures 22 are so dimensioned that the locking spring 30 is guided in the apertures 22.

The recesses 13 in the channel walls 11 are so constructed that they are partially covered by a bent-over section 15 of the frame. This frame section 15 comprises a stopping surface 17. Hence the frame 14 not only protects the upper edges 12 of the channel walls 11, but also serves as a stopping means.

The apertures 22 have a bottom edge 36 so constructed that in the locked state, the fixing element 30 extends between the bottom edge 36 and the stopping surface 17 of the recess, and when the cover 20 is lifted off, a shear force is imposed thereon.

Figure 2:
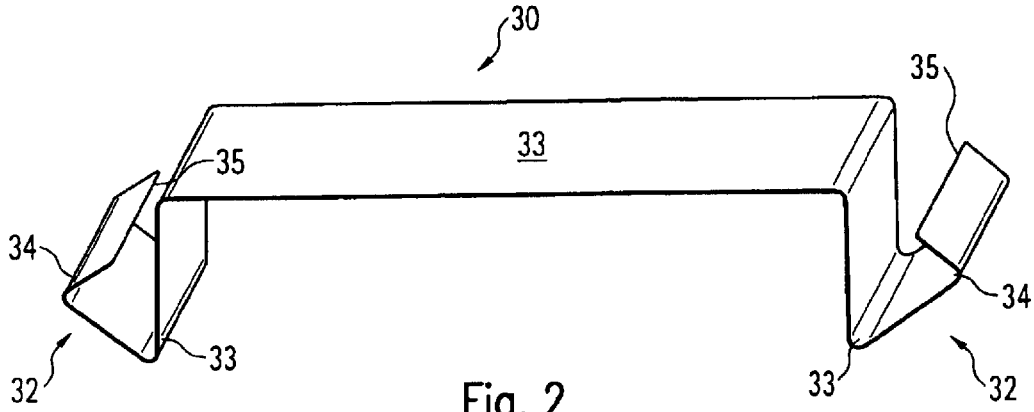
FIG. 2 is a perspective view of the locking spring.

The locking spring 30 is constructed as a leaf spring and, as can also be seen in FIG. 2, comprises a flat middle section 31 plus two mirror-symmetrical extensions 32. The extensions 32 are bent into a conically tapering shape, with a first curved section 33 and a second curved section 34. The second section 34 is lug-shaped and serves both to attach the locking spring 30 to the cover 20 and, once the locking spring 30 has been inserted into the cover 20, to fix the latter to the channel body 10. The free ends 35 of the locking spring 30 extend toward the interior of the channel.

Figure 3:
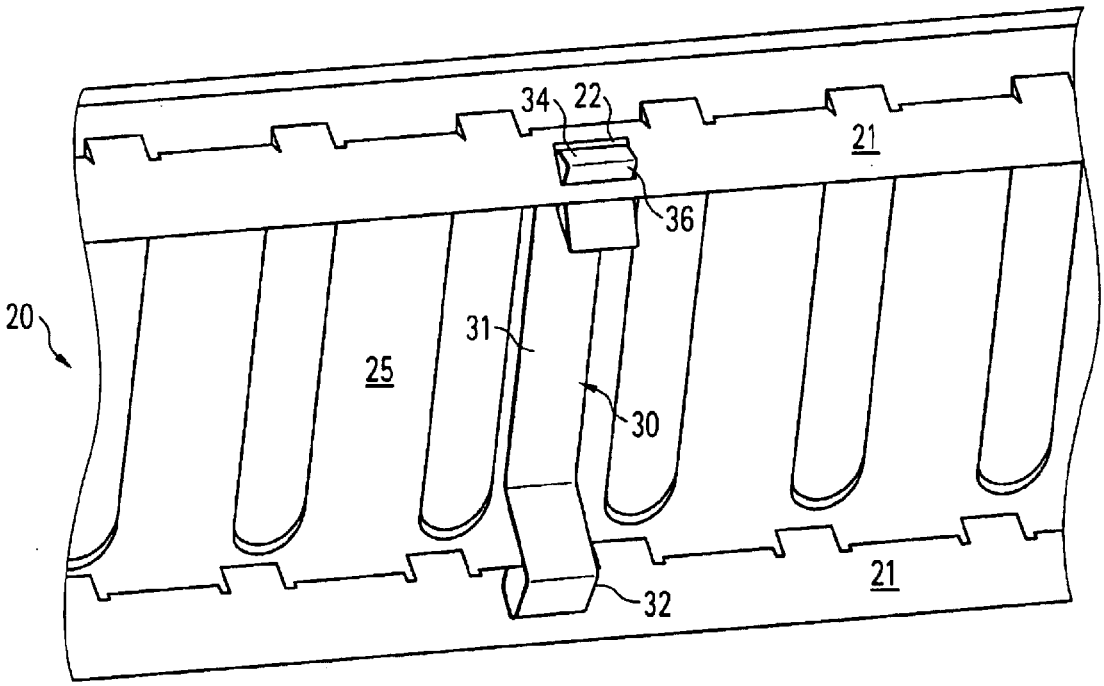
FIG. 3 is a perspective view of a cover with locking spring inserted.

FIG. 3 shows in perspective the cover 20 with locking spring 30 inserted. The apertures 22 in the detent ridges 21 are disposed in such a way that when the locking spring 30 has been inserted, its middle section 31 is apposed to the underside of a grid bar 25. This illustration makes clear that the middle section 31, which is considerably longer than the extensions 32, is dimensioned so that its length corresponds substantially to the width of the cover. The width of the middle section 31 corresponds substantially to the width of a bar in the grid. As a result, the locking springs 30 cannot be seen from above, and the retaining mechanism is safe from vandals.

As can be seen in FIGS. 1 and 3, the retaining lugs 34 engage the apertures 22 of the cover 20 and project out of them. When the cover 20, with locking spring 30 inserted, is being set onto the channel body 10, the retaining lugs 34 slide along the bent-down frame section 15 while exerting pressure thereon. The first angled sections 33 of the extensions 32 are thus moved toward the interior of the channel until the vicinity of the recesses 13 in the channel walls 11 has been reached, whereupon the retaining lugs 34 snap into the recesses, below the frame section 15. The result is that the cover 20 becomes locked to the channel body 10. This locking can be released by applying a pulling force that is considerably higher than the pressure exerted by the locking spring, causing the angled sections 33 of the extensions 32 to be displaced toward the interior of the channel until the retaining lugs are no longer held below the stopping surface 17 of the frame section 15. Thus the cover can be easily lifted off.

List of Reference Numerals

1 Channel body
11 Channel walls
12 Upper edge
13 Recesses
14 Capping frame
15 Frame section
16 Projection
17 Stopping surface
20 Cover
21 Detent ridge
22 Apertures
23 Lower surface
24 Double-layered surface
25 Bar of grid
26 Ends of the detent ridge
30 Locking spring
31 Middle section
32 Extensions
33 First angled section
34 Second angled section (retaining lug)
35 Ends of the locking spring
36 Bottom edge

What is claimed is:

1. A cover for a drawing device, in which a drainage channel defined by a channel body has an upper edge on which the cover can be set, comprising:

detent ridges that can extend into the channel body, and at least one fixing element to attach the cover either to a channel wall of the canal body or to a capping frame disposed on the channel body to reinforce its upper edge such that in a locked state the fixing element engages a recess defined by the channel wall and the frame, the detent ridges extending into the channel body and themselves defining at least one aperture to guide the fixing element which projects out of the aperture, wherein the fixing element is constructed as a locking spring with a middle section that extends substantially along the cover and is attached to a lower surface of the cover, and one end of the fixing element is provided with extensions that project out of the aperture.

2. The cover according to claim 1, wherein the extensions are so constructed that in use they define inclined surfaces that are tilted away from the horizontal, and they comprise a first angled section and a second angled section that serves as a retaining lug.

3. The cover according to claim 2, wherein the fixing elements are so constructed that when the cover is set onto the channel body, retaining lugs of the fixing elements, which project out of the apertures in the cover, slide along the channel body or the frame, in which process an imposed pressure causes elastic deformation of the fixing elements in the direction of the channel interior, so that when the cover has been placed in a final position on the channel body, the retaining lugs snap into the recesses.

4. The cover according to claim 3, wherein the fixing element is so constructed that the force needed to deform the fixing element when the cover is being put into position is lower than the force needed to release the locking and to lift the cover away.

5. The cover according to claim 1, wherein a bottom edge of the aperture is so constructed that in the locked state the fixing element is inserted between the bottom edge of the aperture and a stopping surface of the recess, so that a shear force is applied thereto when the cover is lifted off the drainage device.

6. The cover according to claim 5, wherein is attached to the capping frame that is angled toward a floor of the channel and forms the stopping surface for engagement with the fixing element.

7. The cover according to claim 1, which is attached to the capping frame and wherein when the cover is in the state of being locked onto the frame, the fixing element fores the cover against the frame.

8. The cover according to claim 1, wherein the recess in the channel wall is designed such that the channel body has no opening in the region of its outer surface.

9. The cover according to claim 1, wherein a width of the fixing element corresponds substantially to a width of the recess in the channel wall.

10. The cover according to claim 1, wherein the fixing element is constructed in one piece from a plastics material.

11. The cover according to claim 1, wherein the fixing element is constructed in one piece from sheet metal.

12. The cover according to claim 1, wherein the cover is shaped from one of sheet steel, stainless steel, and plastic.

13. The cover according to claim 1, wherein the cover is constructed as a barred grid and the fixing element is disposed below a bar of the grid so that it is inaccessible from the surface.

14. A cover for a drainage device, in which a drainage channel defined by a channel body has an upper edge on which the cover can be set, comprising:

detent ridges that can extend into the channel body, and at least one fixing element to attach the cover either to a channel wall of the canal body or to a capping frame disposed on the channel body to reinforce its upper edge such that in a locked state the fixing element engages a recess defined by the channel wall and the frame, the detent ridges extending into the channel body and themselves defining at least one aperture to guide the fixing element which projects out of the aperture, wherein the fixing element is constructed as a locking spring, with a middle section that extends substantially along the cover and is attached to a lower surface of the cover, and one end of the fixing element is provided with extensions that project out of the aperture, and wherein the extensions are so constructed that in use they define inclined surfaces that are tilted away from the horizontal, and they comprise a first angled section and a second angled section that serves as a retaining lug.

15. The cover according to claim 14, wherein a bottom edge of the aperture is so constructed that in the locked state the fixing element is inserted between the bottom edge of the aperture and a stopping surface of the recess, so that a shear force is applied thereto when the cover is lifted off the drainage device.

16. The cover according to claim 14, wherein the fixing elements are so constructed that when the cover is set onto the channel body, retaining lugs of the fixing elements, which project out of the apertures in the cover, slide along the channel body or the frame, in which process an imposed pressure causes elastic deformation of the fixing elements in the direction of the channel interior, so that when the cover has been placed in a final position on the channel body, the retaining lugs snap into the recesses.

17. The cover according to claim 14, which is attached to the capping frame and wherein when the cover is in the state of being locked onto the frame, the fixing element forces the cover against the frame.

18. The cover according to claim 17, wherein the fixing element is so constructed that the force needed to deform the fixing element when the cover is being put into position is lower than the force needed to release the locking and to lift the cover away.

19. The cover according to claim 14, wherein the recess in the channel wall is designed such that the channel body has no opening in the region of its outer surface.

* * * * *